US006544011B2

(12) United States Patent
Hsieh

(10) Patent No.: US 6,544,011 B2
(45) Date of Patent: Apr. 8, 2003

(54) HEAT DISSIPATING FAN WITH AN OIL GUIDE

(76) Inventor: Hsin-Mao Hsieh, No. 6, East Section, Chiao Nan Li, Industrial 6th Rd., Pingtung City, Pingtung Hsien (TW)

( * ) Notice: Subject to any disclaimer, the term of this patent is extended or adjusted under 35 U.S.C. 154(b) by 9 days.

(21) Appl. No.: 09/855,774

(22) Filed: May 16, 2001

(65) Prior Publication Data

US 2002/0172609 A1 Nov. 21, 2002

(51) Int. Cl.[7] ..... F04B 17/00
(52) U.S. Cl. ..... 417/423.7; 417/423.13
(58) Field of Search ..... 417/423.7, 423.1, 417/423.12, 423.13

(56) References Cited

U.S. PATENT DOCUMENTS 4,801,252 A * 1/1989 Wrobel ..... 417/423.12
4,968,910 A * 11/1990 Meier et al. ..... 310/258
6,010,318 A * 1/2000 Li ..... 415/229
6,102,675 A * 8/2000 Hsieh ..... 417/423.13
6,246,140 B1 * 6/2001 Horng ..... 417/423.12
6,270,325 B1 * 8/2001 Hsieh ..... 417/423.12
6,309,190 B1 * 10/2001 Chen ..... 417/423.1
6,318,976 B1 * 11/2001 Hsieh ..... 417/423.12

* cited by examiner

*Primary Examiner*—Cheryl J. Tyler
*Assistant Examiner*—Michael K. Gray
(74) *Attorney, Agent, or Firm*—Stuart J. Friedman; Nixon Peabody

(57) ABSTRACT

A heat dissipation fan has a casing, a stator, a lubricating bushing and a fan. The stator is secured to the casing with a sleeve. The lubricating bushing has lubricant contained therein and is mounted in the sleeve. The fan is rotatably mounted in the casing and has a permanent magnet to be a rotor. A shaft extends from the fan and through a passage defined through the lubricating bushing. A locking disk is securely mounted on the shaft to hold the lubricating bushing. An oil guide is arranged on the lubricating bushing. Accordingly, the air in the cavity can be released from the oil guide during the assembly of the dissipation fan. The oil guide can keep oil from flowing out of the sleeve and drying out the lubricating bushing. The useful life of the dissipation fan is prolonged.

5 Claims, 6 Drawing Sheets

HEAT DISSIPATING FAN WITH AN OIL GUIDE

BACKGROUND OF THE INVENTION

1. Field of the Invention

The present invention relates to a heat dissipating fan, and more particularly to a heat dissipating fan with an oil guide for a lubricating bushing.

2. Description of Related Art

With reference to FIG. 5, a conventional heat dissipation fan in accordance with the prior art comprises a casing (50), a stator (60), a lubricating bushing (70) and a fan (80). The fan (80) is rotatably mounted in the casing (50). The stator (60) with an electromagnet and a circuit board (62) is securely mounted in the casing (50). A permanent magnet (not numbered) is mounted in the fan (80) to be a rotor, such that the fan (80) can rotate due to the interaction between the magnetic forces in stator (60) and the permanent magnet. A sleeve (61) pressed into the stator (60) is engaged with an annular groove (53) defined around a base (52) formed in the casing (50). A lubricating bushing (70) has a lubricant impregnated in the material forming the lubricating bushing (70). The lubricating bushing (70) is pressed into the sleeve (61). A shaft (81) extends from the fan (80) and through a passage (71) defined through the bushing (70). A locking disk (63) is mounted in a neck (82) defined near the free end of the shaft (81) to securely hold the shaft (81) in the bushing (70). Accordingly, the fan (80) can rotate relative to the casing (50) with very little friction. A cavity (521) is defined in the top of the base (52), such that a chamber is defined in the base to hold the lubricant oil from the lubricating bushing (70) as the dissipation fan is operated.

To assemble the conventional heat dissipation fan, the locking disk (63) is put on the base (52) and covers the cavity (521). The shaft (81) aligns with the passage (71) in the bushing (70), the bushing (70) aligns with the sleeve (61) and the sleeve (61) aligns with the annular groove (53) around the base (52). The fan (80) is then pressed with a press machine. The shaft (81) will extend through the passage (71) in the bushing (70) and engage with the locking disk (63), the bushing (70) is pressed into the sleeve (61) and the sleeve (61) is pressed into the annular groove (53). Consequently, the assembly of the conventional dissipation fan is completed.

However, during the assembly of the conventional heat dissipation fan, the air contained in the cavity (521) cannot be released and high pressure will build up in the chamber. The high pressure will resist the assembly of the dissipation fan. In addition, the lubricant easily flows out due to the pressure in the chamber, so the bushing (70) will easily dry out. The useful life of the heat dissipation fan is decreased.

To overcome the shortcomings, the present invention provides an improved heat dissipation fan to mitigate or obviate the aforementioned problems.

SUMMARY OF THE INVENTION

The main objective of the invention is to provide an improved heat dissipation fan with an oil guide. The dissipation fan has a casing, a stator, a lubricating bushing and a fan. The casing has a base with a cavity defined in the top of the base. A sleeve is pressed onto to the base, and the stator is pressed onto the sleeve so as to be attached to the base. Lubricant is impregnated in the material used to form the bushing, and the lubricating bushing is mounted in the sleeve. The fan is rotatably mounted in the casing and has a permanent magnet as a rotor. A shaft extends from the fan and through a passage defined through the lubricating bushing. A locking disk is securely mounted on a free end of the shaft to lock the shaft in the lubricating bushing. An oil guide is formed on the lubricating bushing through which the lubricant recycles during the operation of the dissipation fan. With such an arrangement, the build up of the air pressure in the cavity during the assembly of the dissipation fan is released through the oil guide. A pressure balance between the cavity and the environment is achieved. The oil guide can keep oil from flowing out of the sleeve and drying out the lubricating bushing. The useful life of the dissipation fan is prolonged.

Other objects, advantages and novel features of the invention will become more apparent from the following detailed description when taken in conjunction with the accompanying drawings.

DETAILED DESCRIPTION OF PREFERRED EMBODIMENT

Figure 1:
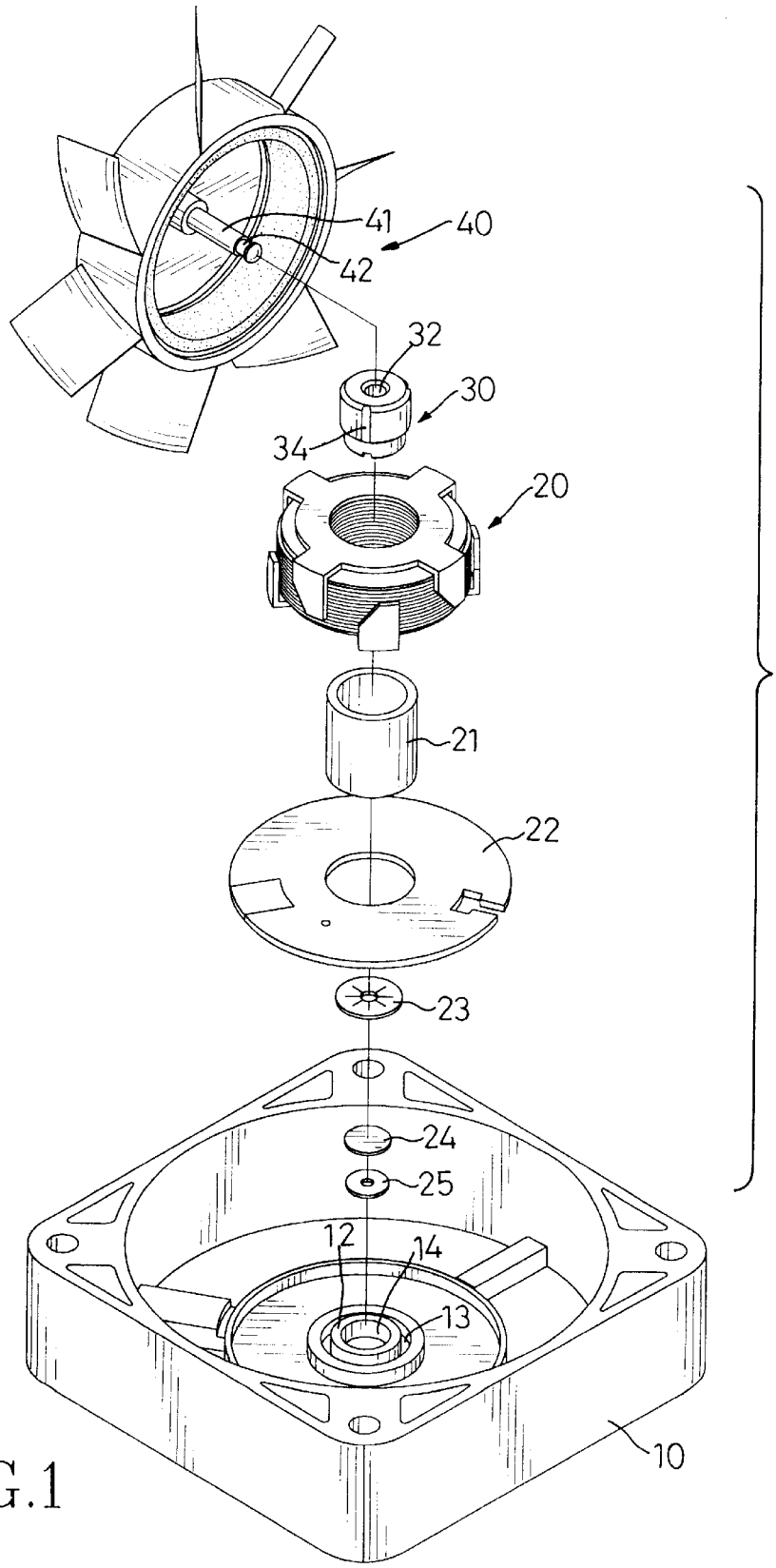
FIG. 1 is an exploded perspective view of a heat dissipation fan in accordance with the present invention.
Figure 3:
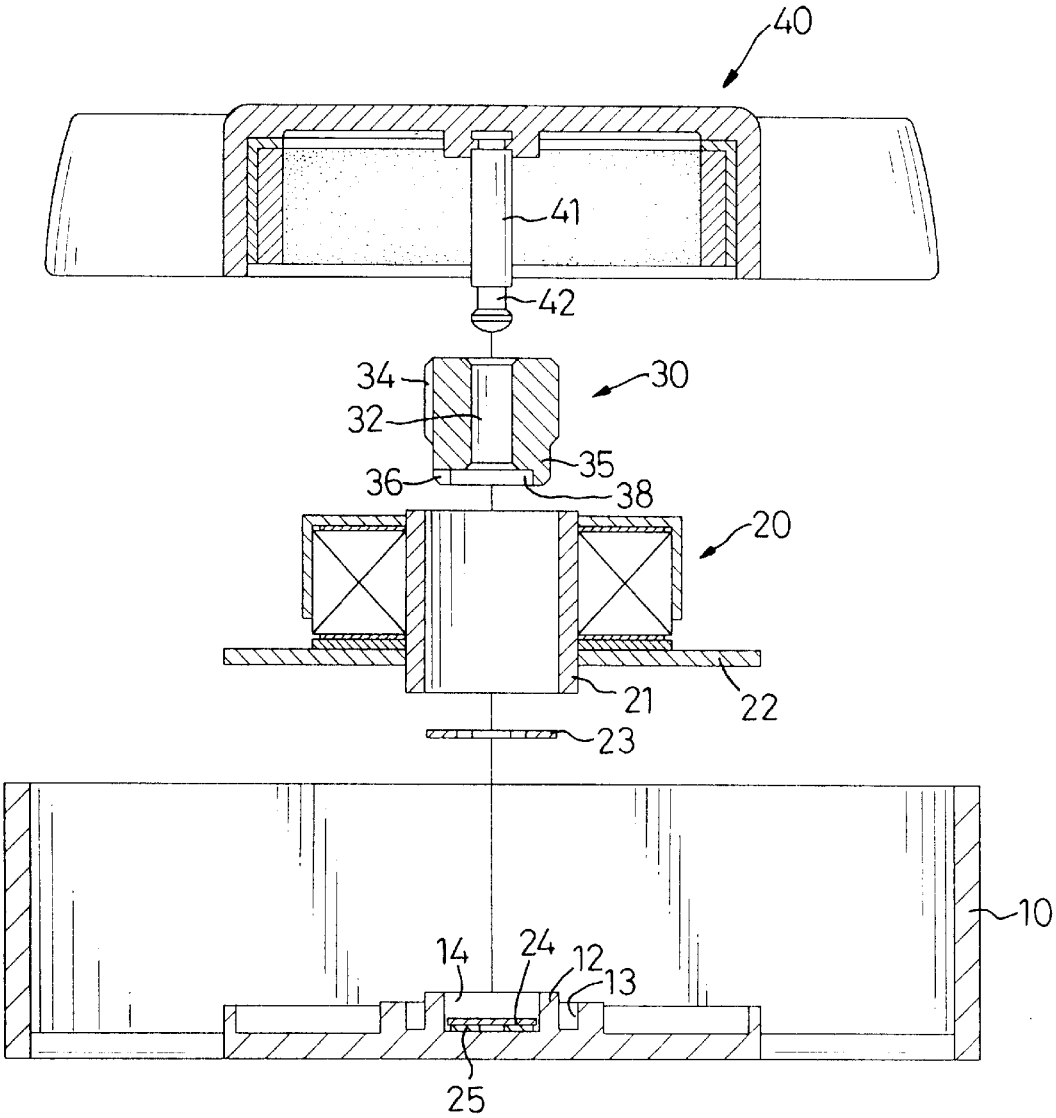
FIG. 3 is an exploded side plan view in partial section of the heat dissipation fan in FIG. 1.

With reference to FIGS. 1 and 3, a heat dissipation fan in accordance with the present invention comprises a casing (10), a stator (20), a lubricating bushing (30) and a fan (40). A chamber (not numbered) is defined in the casing (10) to receive the fan (12). A base (12) with a cavity (14) is formed in the casing (10). An annular groove (13) is defined around the base (12).

The stator (20) is securely mounted in the chamber of the casing (10). A sleeve (21) is pressed into the stator (20) and is securely mounted in the casing (10) by pressing one end of the sleeve (21) into the annular groove (13). A circuit board (22) is attached to the stator (20).

With reference to FIGS. 1, 2, 3 and 4, the lubricating bushing (30) contains lubricant and is securely mounted in the sleeve (21). A passage (32) is defined through the lubricating bushing (30). A protrusion (35) with a diameter smaller than that of the lubricating bushing (30) axially extends from the lubricating bushing (30), such that an annular space (37) is defined around the protrusion (35) when the lubricating bushing (30) is pressed into the sleeve (21). A chamber (38) is defined in the free end of the protrusion (35) and communicates with the passage (32) in the lubricating bushing (30). At least one notch (36) is defined in the free end of the protrusion (35) and communicates with the chamber (38). At least one oil groove (34) is longitudinally defined in the outer periphery of the lubricating bushing (30). Consequently, an oil guide is constructed of the passage (32), the chamber (38), the notches (36), the annular space (37) around the protrusion (35) and the oil grooves (34).

Figure 4:
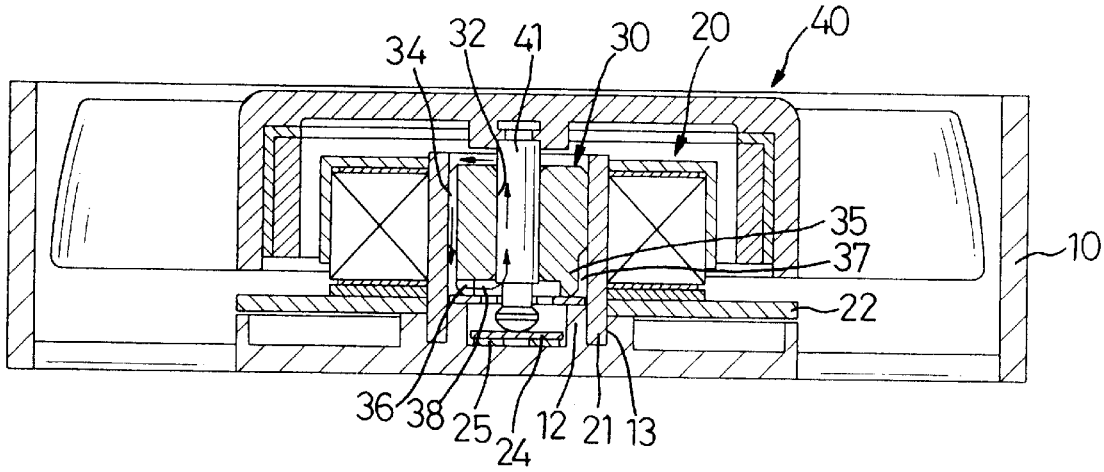
FIG. 4 is a side plan view in partial section of the heat dissipation fan in FIG. 1 showing the direction of the lubricant flow.
Figure 5:
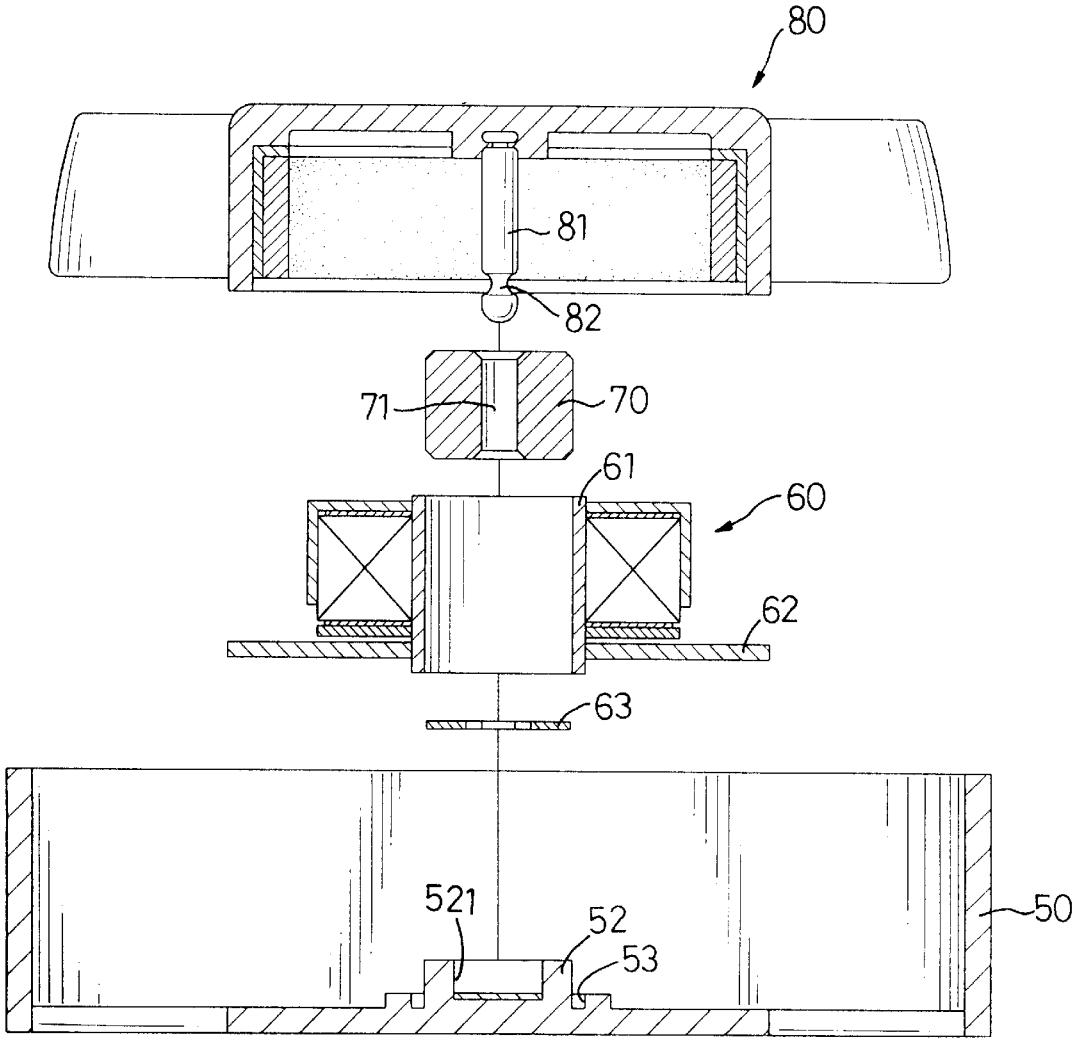
FIG.5 PRIOR ART
FIG. 5 is an exploded side plan view in partial section of a conventional heat dissipation fan in accordance with the prior art.
Figure 6:
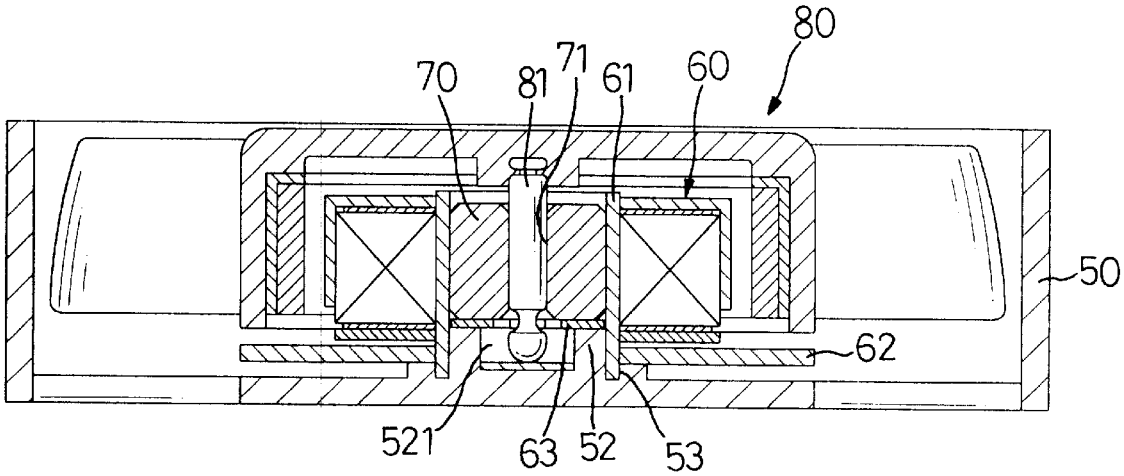
FIG.6 PRIOR ART
FIG. 6 is a side plan view in partial section of the conventional heat dissipation fan in FIG. 5.

With reference to FIGS. 1, 3 and 4, the fan (40) is rotatably mounted in the casing (10). The fan (40) has multiple blades arranged on the outer periphery of the fan (40). A permanent magnet (not numbered) is mounted in the fan (40) to be the rotor. A shaft (41) extends from the fan (40) and through the passage (32) in the lubricating bushing (30). A neck (42) is defined near the free end of the shaft (41), such that a head (43) is formed on the free end of the shaft (41). A locking disk (23) with a central hole securely engages the neck (42) on the shaft (41) to securely hold the shaft (41) in the bushing (30). In addition, a thrust pad (24) is received in the cavity (14) in the base (12) to abut the free end of the shaft (41) to prevent the free end of the shaft (41) from wearing off. A cushion (25) is received in the cavity (14) below the thrust pad (24) to absorb the vibration of the shaft (41) when the shaft (41) is rotating.

Figure 2:
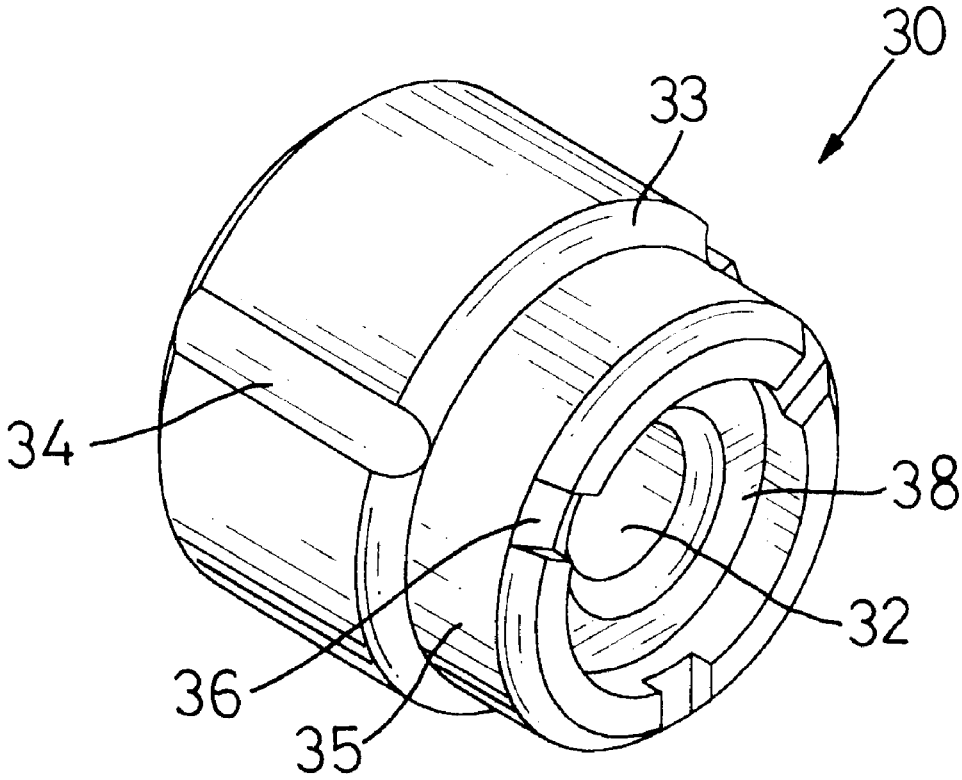
FIG. 2 is a perspective view of a lubricating bushing for the heat dissipation fan in FIG. 1.

With reference to FIGS. 1–3, when the heat dissipation fan is assembled, the cavity (14) in the base (12) will communicate with the outer atmosphere through the chamber (38) in the protrusion (35), the notches (36), the annular space around the protrusion (35) and the oil grooves (34). High pressure will not build up in the cavity (14), and to assemble the dissipation fan becomes easier. A pressure balance between the cavity (14) and the environment is achieved.

During the operation of the dissipation fan, with reference to FIGS. 1 and 4, the lubricant will flow from the lubricating bushing (40) and through the passage (42) to the top of the lubricating bushing (30). Because the pressure in the cavity (14) in the base (12) is not high and the bushing (30) is stationary during the operation of the dissipating fan, the lubricant can flow back to the chamber (38) through the oil grooves (34), the annular space (37) around the protrusion (35) and the notches (36) due to the gravity of the lubricant. The lubricant can recycle through the oil guide. This keeps the lubricant from leaking out of the sleeve (21) and drying out the bushing (30). In addition, the oil can provide a lubricating effect to the shaft (41). This can further reduce the friction between the shaft (41) and the lubricating bushing (30) to avoid noise and wear. The useful life of the heat dissipation fan is prolonged.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A heat dissipation fan comprising:

a casing having a base with a cavity defined in a top of the base;

a sleeve pressed onto the base;

a stator pressed onto the sleeve;

a lubricating bushing with lubricant contained therein and mounted in the sleeve;

a fan rotatably mounted in the casing and having a permanent magnet to serve as a rotor;

a shaft extending from the fan and through a passage defined through the lubricating bushing;

a locking disk securely mounted on a free end of the shaft to lock the shaft in the lubricating bushing; and an oil guide arranged on the lubricating bushing through which the lubricant recycles when the dissipation fan is operating, wherein a protusion with a diameter smaller than that of the lubricating bushing axially extends from the lubricating bushing so as to define an annular space around the protusion when the lubricating bushing is pressed into the sleeve;

a chamber is defined in a free end of the protrusion and communicates with the passage in the lubricating bushing;

at least one notch is defined in the free end of the protrusion and communicates with the chamber and the annular space around the protrusion; and at least one oil groove is longitudinally defined in an outer periphery of the lubricating bushing and communicates with the annular space around the protrusion, thereby an oil guide constructed of the chamber in the protrusion, the passage in the lubricating bushing, the at least one oil groove, the annular space around the protusion and the at least one notch is provided.

2. The dissipation fan as claimed in claim 1, wherein a neck is defined near the free end of the shaft to engage with the locking disk.

3. The dissipation fan as claimed in claim 1, wherein an annular groove is defined around the base to engage with one end of the sleeve so as to secure the sleeve to the base.

4. The dissipation fan as claimed in claim 1, wherein a thrust pad is received in the cavity of the base to abut the free end of the shaft so as to prevent the shaft from wearing off.

5. The dissipation fan as claimed in claim 4, wherein a cushion is received in the cavity below the thrust pad to absorb vibration of the shaft when the shaft is rotating.

* * * * *